United States Patent [19]

Mason

[11] 4,426,079

[45] Jan. 17, 1984

[54] POLICE RESTRAINT DEVICE

[76] Inventor: James R. Mason, Box 2321, Idaho Falls, Id. 83401

[21] Appl. No.: 360,110

[22] Filed: Mar. 19, 1982

[51] Int. Cl.[3] ..... F41B 15/02

[52] U.S. Cl. ..... 273/84 R; 128/133

[58] Field of Search ..... 273/84 R, 58 C, 193 R, 273/80.6, 84 ES; 128/133, 134

[56] References Cited

U.S. PATENT DOCUMENTS

| | | | |
|---|---|---|---|
| 2,050,801 | 8/1936 | Lard | 273/80.6 X |
| 3,428,325 | 2/1969 | Atkinson | 273/193 R X |
| 3,934,877 | 1/1976 | White | 273/84 R |
| 4,113,257 | 9/1978 | Moffatt | 273/58 C X |

*Primary Examiner*—George J. Marlo

*Attorney, Agent, or Firm*—Lynn G. Foster

[57] ABSTRACT

A police restraint device utilizing the principle of the second class lever and method of making the device, the device in its disclosed form comprising a presently preferred arm clamp having two rigid elongated handles or sticks, adapted to be held and manipulated manually, with a single strong flexible cord or rope of predetermined length spanning between and integrally joining the distal ends of the handles one to the other. Each end of the cord is snugly enclosed within a crimped metal cap or sleeve which in turn is snugly inserted in a blind bore at the distal end of the associated stick and pin-secured in that position.

5 Claims, 9 Drawing Figures

POLICE RESTRAINT DEVICE

BACKGROUND

1. Field of Invention

This invention relates generally to law enforcement and more particularly to a novel police restraint device and related method.

2. Prior Art

The traditional restraint device for the police are handcuffs. However, there has always existed a serious problem in applying the handcuffs to a resisting person. Various impact weapons have been devised heretofore to overcome that resistance and enable a policeman or like person to control another person against his will by inflicting pain and injury. For example, many police organizations issue the so-called "night stick," which has historically proven to be a serious injury producing weapon. Similarly, one end of the so-called "nunchaku" and similar devices is held in the hand of the user while the other end is twirled at high speed via a connecting chain or plurality of handle joining cords, allowing the opponent to be struck with a powerful impact. The last-mentioned device is not used by police because substantial injury is typically inflicted upon the person being apprehended, as is common with other impact weapons. Attempts to use the nunchaku and like devices as a restraint have failed owing to breakage and their requiring both hands of the officer to maintain a controlling pressure; thus leaving no free hand to manipulate the handcuffs.

Heretofore, there has existed no reliable device of the type in question which was effective, simple to use, and reliable and by which the police officer could restrain and control a suspect being arrested by inflicting pain without serous injury.

BRIEF SUMMARY AND OBJECTS OF THE INVENTION

In brief summary, the present invention comprises a novel and unobvious police restraint device which is highly effective without being highly injurious and which is intended to restrain and control a suspect being apprehended by inflicing pain without causing serious injury, the device comprising two elongated manually manipulatable handles interconnected by a single length or strand of cord using unique fastening structure to inseparably secure the cord at its ends to the handles. Preferably, the cord length separates the handles by the proper distance to provide an optimum capability to entrap and apply pressure to the human forearm.

With the foregoing in mind, it is a primary object of this invention to provide a reliable novel police restraint device and method of making the device.

It is another primary object of this invention to provide a reliable novel device by which a police officer may restrain and control a resisting person and yet have one of his hands free to apply handcuffs.

A further significant object of the present invention is the provision of a novel police restraint device to be used to control a suspect being apprehended by inflicting pain without serious injury.

A further object of the present invention is to provide a highly reliable novel police restraint device which is simple to use and obviates the need for complex or extensive training.

An additional important object is the provision of a unique police restraint device which can be used as a striking device if necessary but which is intended to be used as a "restraint" to inflict pain in proportion to resistance without serious injury in controlling another person.

Another major object of this invention is the provision of a police restraint device and related method, the device comprising two handles and a cord interposed between and novelly connected to the handles, the connection providing the increased strength required for the device to function reliably as a restraint.

These and other objects and features of the present invention will be apparent from the detailed description taken with reference to the accompanying drawings.

DETAILED DESCRIPTION OF THE ILLUSTRATED EMBODIMENT

Reference is now made to the drawings wherein like numerals are used to designate like parts throughout and which illustrates a presently preferred economical police restraint device, generally designated 10, together with steps practiced to manufacture the same, all in accordance with the present invention. It is intended that device 10 function as a powerful arm clamp to replace the traditional police club or night stick as a more humane tool for effecting the arrest of a resisting person since it inflicts substantial pain due to the powerful pinch even through clothing, without substantial risk of injury to the person arrested.

Of course, in the event the police officer were attacked by the resisting person, the device 10 may be used for striking the person's arms and legs. Thus, the roll of the device 10 in law enforcement is to fill the gap between verbal command and hand gun, eliminating the night stick. Not all citizens will submit to a lawful arrest, but this does not mean that they should be shot or beat upon. Typically the police officer is routinely faced with arresting persons who physically resist and unless the officer can "out muscle" the resisting person, he must inflict injury using existing police weapons, with the attending prospect of bad press and perhaps litigation.

Figure 4:
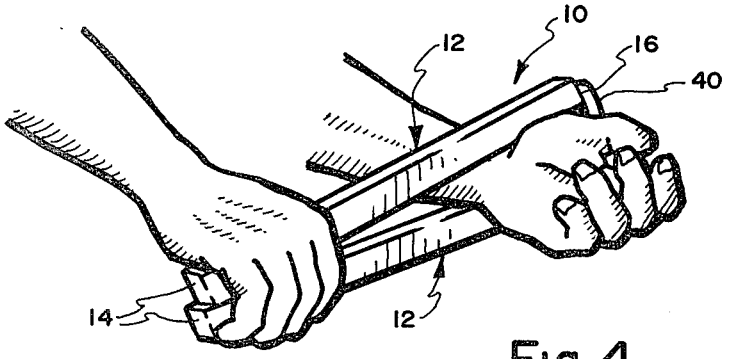
FIG. 4 is a perspective represenation of the preferred manner of use of the police restraint device of FIG. 1 in apprehending a suspect.
Figure 5:
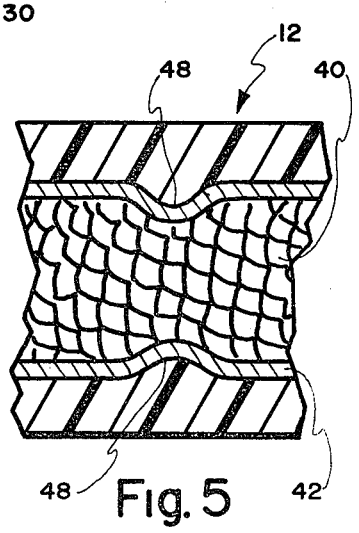
FIG. 5 is an enlarged fragmentary cross section taken along 5—5 of FIG. 3.

The primary purpose of device 10 is to trap and pinch an opponent's arm, as generally illustrated in FIG. 4. The officer may, with a few readily learned maneuvers, apply the device to a suspect's arm and easily bring him under control, applying to the trapped arm as much clamping pressure as required to subdue the suspect, even when he is combative. Once the resisting person is so subdued, he can readily be placed in a hand cuffing position without violence or serious injury because the clamping pressure can be maintained by one hand of the officer thus freeing his other hand to apply the handcuffs. This one hand control is possible because the device functions as a second class lever and amplifies the user's effort. See FIG. 4.

The police restraint device 10 comprises a pair of elongated handles, each generally designated 12 having a proximal end 14 and a distal end 16. Each handle 12 is preferably of rigid synthetic resinous material. The handles 12 are, in the illustrated embodiment, preferably on the order of 12 inches in length with about a $\frac{7}{8}''$ square cross section. Each handle is chamfered at sites 18 at the proximal end 14 and chamfered along each corner edge along sites 20 from the proximal end 14 for most of the length of the handle, the chamfers 20 terminating at sites 22 providing sharp corners 24 along the arm clamping area from sites 22 to the distal end 16.

Figure 3:
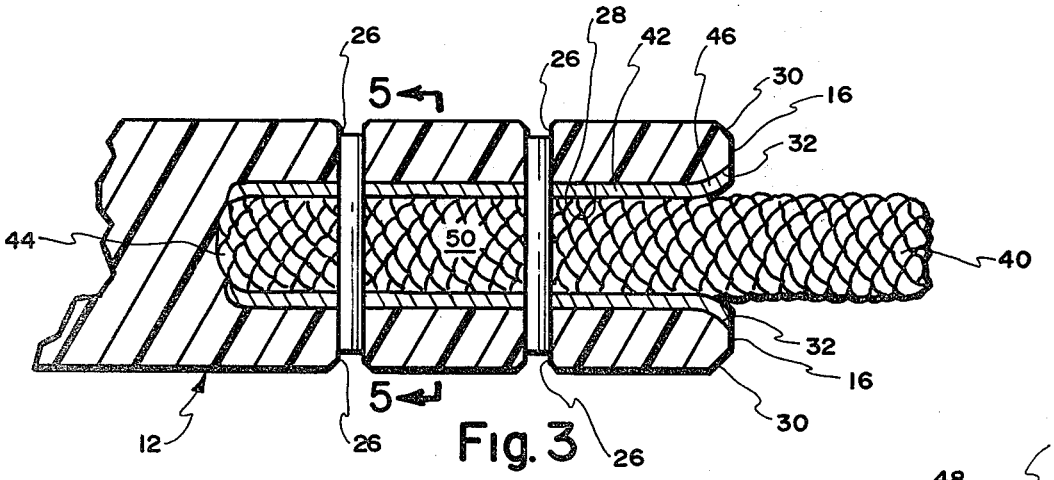
FIG. 3 is an enlarged fragmentary cross section taken along lines 3—3 of FIG. 1 illustrating the manner in which the ends of the cord encapsulated within a crimped sleeve-like member are inseparably secured to the handles of the device.

Each handle 12 is preferably of rigid synthetic resinous material such as nylon, melamine plastic, or fiberglass reinforced thermosetting resin. Each handle in the illustrated embodiment comprises transverse bores 26 adjacent the distal end 16. As can be seen in FIG. 3, the distal end 16 of each handle 12 comprises an axially directed symmetrically disposed blind bore 28 thereby defining a total of four transverse bores 26, pairs of which are in alignment. The distal end 16 of each handle 12 is chamfered at sites 30 (FIG. 3). The blind bore 28 is generally of uniform diameter throughout but is flared at site 32 where the bore merges with the distal end 16.

The two handles or sticks 12 are reliably, integrally and inseparably joined one to the other by a single strand of cord or rope 40, illustrated as being of braided or woven stock. It is presently preferred that woven or braided nylon rope be utilized, although other types of cord and rope of sufficient strength could be utilized just as other handle material could be utilized without departing from the scope of the present invention.

Figure 2:
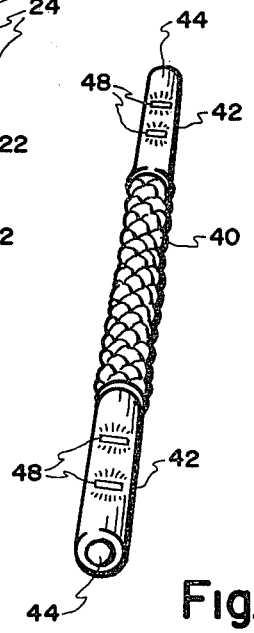
FIG. 2 is a perspective representation of the cord encapsulated at its ends by sleeve-like members used to interconnect the handles of the police restraint device of FIG. 1.

Each end of the cord 40, best illustrated in FIG. 2, is encapsulated within a surrounding thin wall metal sleeve-like member 42. While closed end caps could be used, it is presently preferred that the sleeve like member 42 comprise a metal sleeve or annulus with the exposed cord end 44 being melted to prevent fraying. The unaltered inside and outside diameters of each sleeve 42 are uniform throughout with the exception that the end 46 is flared slightly to fit against handle site 32, the otherwise uniform inside diameter of the sleeve being substantially equal to the outside diameter of the cord 40. Each sleeve 42 is not pre-drilled with transverse openings.

Each sleeve 42 is crimped at opposing locations 48 at two sites along the length thereof using conventional methods for the purpose of inseparably uniting each sleeve 42 with the associated cord end 50 (FIG. 3). In this condition, the rope and crimped sleeves have the appearance illustrated in FIG. 2. If desired, more than two crimps may be used.

Figure 6:
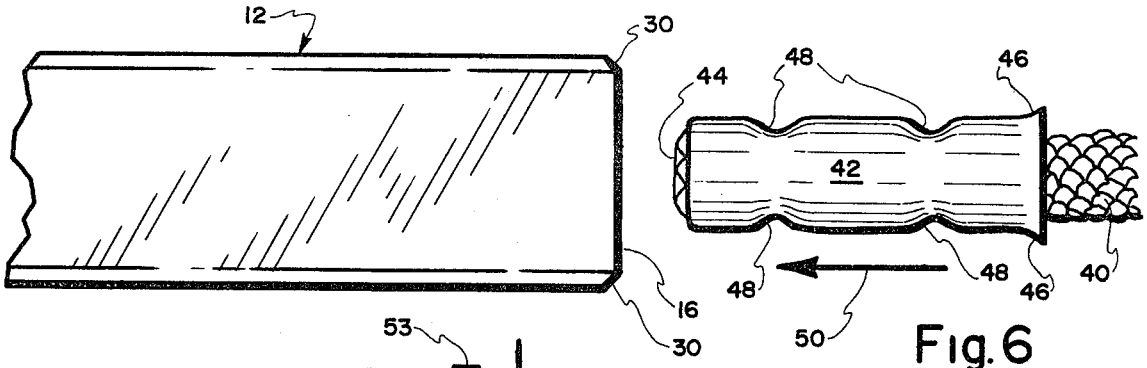
FIG. 6 is a side elevation view of the manner in which the sleeve encapsulated ends of the cord are inserted into a blind bore at the end of each handle.
Figure 7:
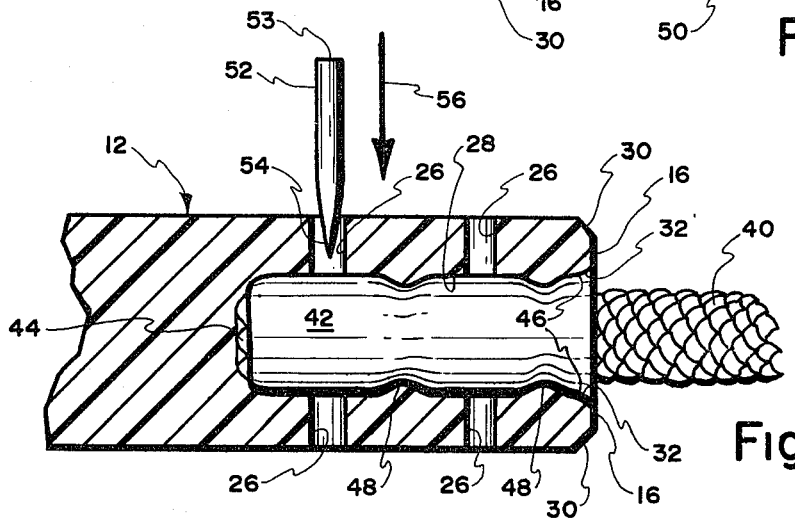
FIGS. 7 through 9 illustrate the manner in which the handles, the sleeve-like members and the cord are inseparably secured to each other.

Next, one of the sleeve encapsulated ends of the cord 40, which preferably has the diameter of 5/16th of an inch, is axially inserted into the blind bore 28 by aligning the sleeve 42 with the blind bore 28 and forcing the two together in the direction indicated by arrow 50 of FIG. 6. Force, in any conventional form, may be applied to the bevelled lip 46 of the sleeve to force the sleeve 42 snugly and firmly into the blind bore 28 of the handle. Thus, the handle 12, the cord 40 and the sleeve 42 are placed in the position illustrated in FIG. 7. Preferably an offset relationship exists between the pairs of aligned bores 26 and the crimp sites 48.

Thereafter, an elongated small diameter piercing instrument 52 having a pointed tip 54 is inserted into one of the transverse bores 26 in the handle 12 which opens into the blind bores 28. Once the pointed tip 54 is caused to engage the exterior surface of the sleeve 42 force is applied in any conventional fashion, e.g. use of a hammer, to the piercing instrument 52 in the direction illustrated by arrow 56 causing the pointed tip 54 to first penetrate the wall of the sleeve 42 and thereafter separate the woven or fiberous parts of the cord 40 without materially severing or shearing any of the woven parts until the pointed tip 54 reaches the opposite interior surface of the sleeve 42.

Figure 8:
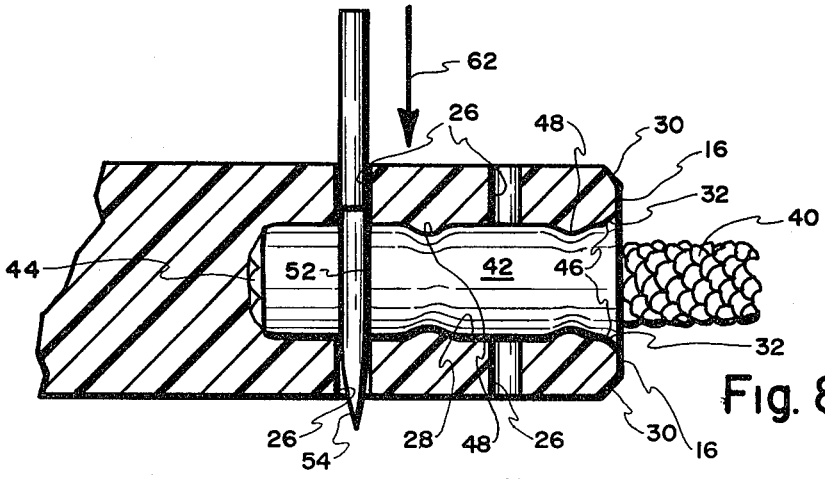

At that time a further force is applied, also as indicated by arrow 56, causing the piercing instrument 52, the diameter of which is slightly less than the diameter of the bores 26, to once more oppositely penetrate the wall of the sleeve 42 and enter the second, aligned transverse bore 26. This position is illustrated in FIG. 8. At this point in time, opposed holes have thus been created in the wall of the sleeve 42 the diameter of which substantially equals the diameter of the piercing instrument 52.

Figure 9:
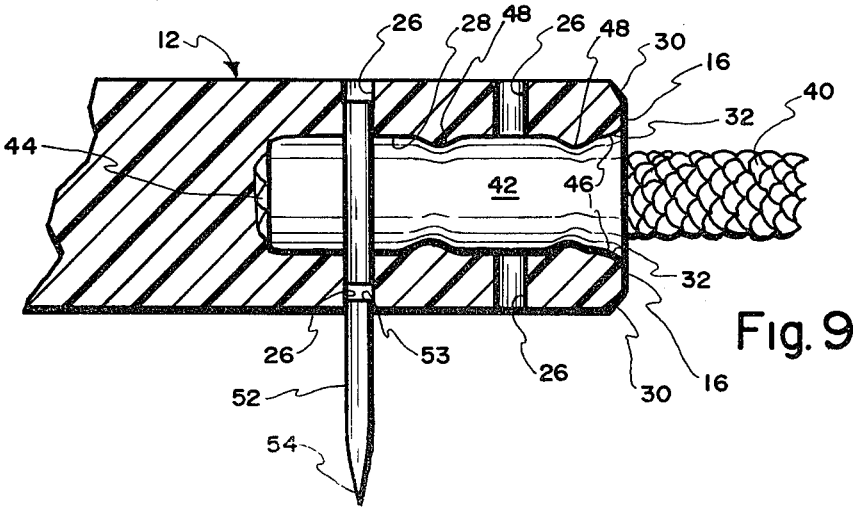

At this point in time, a fastening dowel pin 60 having a diameter substantially the same as the diameter of the transverse bores 26 and a length slightly less than the width of the handle 12 is placed in the initial transverse bore 26 so as to engage the head 53 of the piercing instrument, whereupon force, as schematically illustrated by arrow 62 in FIG. 8, is applied to the pin 60, such as by striking the pin with a hammer and a punch to the extent required. This drives the piercing instrument 52 from the position of FIG. 8 to the position of FIG. 9 whereupon the piercing instrument 52 is removed and the pin 60 permanently impaled through the sleeve 42 and along the opening created by the piercing instrument 52 through the woven parts of the cord 42 to inseparably secure the cord 40 and the sleeve 42 within the bore 28 of the handle.

The same steps are utilized in placing a second dowel pin into the other two aligned transverse bores 26, through the woven parts of the cord 40 and impaled through the sleeve 42 so that the union between the cord 60 and the handle 12 is entirely, under all circumstances, reliable and inadvertent separation of the two handles virtually impossible.

Figure 1:
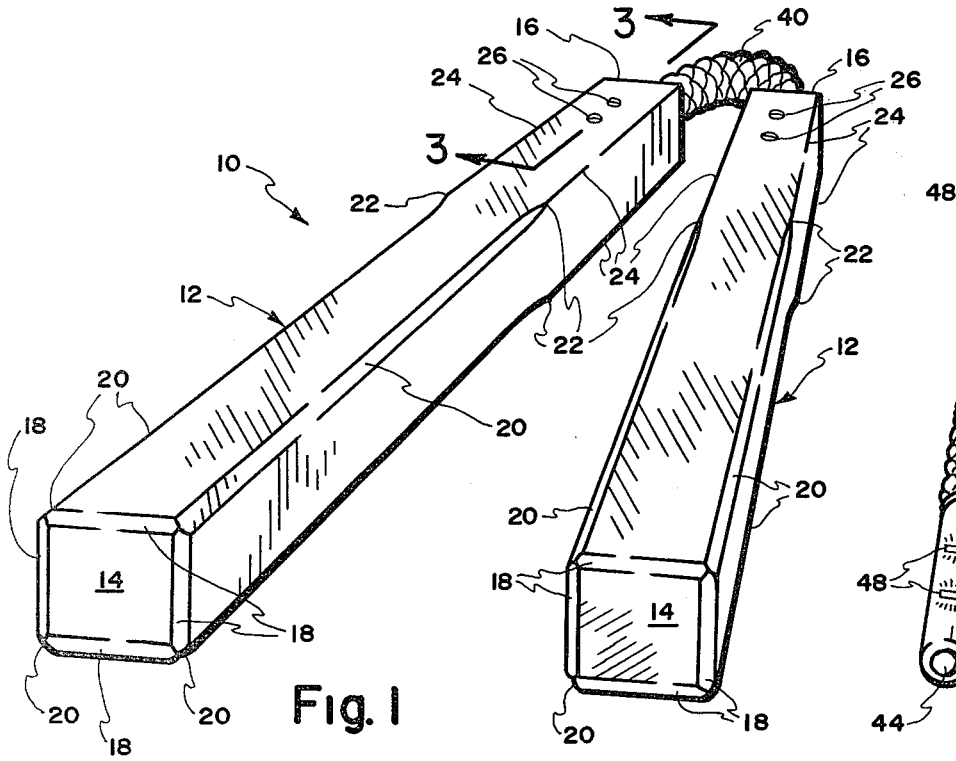
FIG. 1 is a perspective representation of a presently preferred police restraint device fabricated in accordance with the present invention.

The cord 40 together with the second sleeve 42 is united inseparably with the other handle 12 in the manner herein described, to form the device 10, best illustrated in FIG. 1.

It is presently preferred that the length of cord 40 spanning between the two distal ends 16 of the two handles be on the order of $2\frac{1}{4}''$ to provide an effective pinching area for restraining a resisting person in the manner illustrated in FIG. 4. It is also presently preferred that the length of each sleeve 42 be on the order of $1\frac{1}{2}''$.

The device 10, fabricated as described, provides remarkably reliable unions or fastening structure between the cord and the handles via the sleeves and pins so that inadvertent separation does not occur and superior strength is provided that the device more effectively serves its intended purpose.

Tests to date indicate that utilization of a single pin attachment failed when 1,050 pounds of tension was applied axially to the cord. A double pin attachment failed at 1,200 pounds of tension applied axially to the cord. The strength levels far exceed any strength requirements needed for the device to function effectively as indicated.

The invention may be embodied in other specific forms without departing from the spirit or essential characteristics thereof. The present embodiment is therefore considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by United States Letters Patent is:

1. A restraint device for use in law enforcement and the like comprising:

a pair of spaced elongated handles to be held by and manipulated manually by the user, each handle having a major axis and an axially disposed blind bore in the proximal end thereof and a substantial body of handle material surrounding the blind bore;

a single length of cord of essentially non-elastic intertwined fiberous strands spanning between the spaced proximal ends of the handles;

each end of the cord being snugly encased within thin wall hollow metallic sleeve means, each sleeve means being non-rotatably and load transferringly connected to the cord end by a plurality of crimps in the sleeve means, the unstressed and unaltered transverse size of the sleeve means being substantially the same as the transverse size of the blind bore;

each sleeve means and encased and connected cord end being snugly disposed within the blind bore in the proximal end of the associated handle;

load transferring anchor means comprising a plurality of pin means disposed generally transverse of the axis of the associated handle, each pin means (a) passing through the intertwined fiberous strands of the encased cord end in shear load transferring relation and, (b) passing through aligned apertures in the wall of the sleeve means at a site other than the crimp sites in shear load transferring relationship, the ends of each pin means being respectively anchored in spaced aligned generally transverse bores in shear load transferring relation in the handle material surrounding the blind bore, each pin means receiving generally transverse bore in the handle material surrounding the blind bore having a length substantially greater than the wall thickness of the sleeve means, whereby the cord ends are non-rotatably anchored to the respective handle to prevent separation under high stress utilization.

2. A restraint device according to claim 1 wherein each handle is non-circular in cross section and comprises rigid shape-retaining synthetic resinous material.

3. A restraint device according to claim 1 wherein the cord comprises strands of woven nylon.

4. A restraint device according to claim 1 wherein the length of the cord from one sleeve means to the other is on the order of two and one-quarter inches.

5. A restraint device according to claim 1 wherein the length of the cord is such as needed to trap between and apply pressure with the handles to the forearm.

* * * * *